United States Patent [19]

Morita et al.

[11] Patent Number: 4,990,272

[45] Date of Patent: Feb. 5, 1991

[54] GREASE COMPOSITION

[75] Inventors: Masayuki Morita; Sugako Otake, both of Niwa; Eigo Mukasa, Fujisawa; Kikuo Hosaki, Tokyo, all of Japan

[73] Assignees: Kabushiki Kaisha Tokai Rika Denki Seisakusho, Aichi; Nippon Koyu Ltd., Tokyo, both of Japan

[21] Appl. No.: 281,391

[22] Filed: Dec. 8, 1988

[30] Foreign Application Priority Data

Dec. 8, 1987 [JP] Japan ..... 62-311283
Dec. 8, 1987 [JP] Japan ..... 62-311284
Jan. 12, 1988 [JP] Japan ..... 63-5487

[51] Int. Cl.[5] ..... C10M 113/10

[52] U.S. Cl. ..... 252/41; 252/17; 252/38

[58] Field of Search ..... 252/38, 41, 17

[56] References Cited

U.S. PATENT DOCUMENTS 4,315,825 2/1982 Schweizer ..... 252/41
4,897,210 1/1990 Newsoroff ..... 252/38

FOREIGN PATENT DOCUMENTS 0580342 7/1959 Canada .
2572089 4/1986 France .

*Primary Examiner*—Olik Chaudhuri
*Assistant Examiner*—James M. Hunter
*Attorney, Agent, or Firm*—Birch, Stewart, Kolasch & Birch

[57] ABSTRACT

The present invention provides grease a compositions having excellent properties which comprises base oil consisting of specified amounts of a chain hydrocarbon oligomer and the addition polymerization oligomer of alkylene oxide and polyvalent alcohol and the defined amounts of specific additives, such as lithium salt of higher fatty acid, quaternary ammonium salt-containing clay mineral, polar solvents and the like. The grease composition can be applied effectively, for example, on the plastic parts of automobiles, plastic parts of sound apparatus, sliding contact switches and the like.

14 Claims, 6 Drawing Sheets

GREASE COMPOSITION

TECHNICAL FIELD

Background of the Invention

This invention relates to grease compositions which are particularly useful for contacts of sliding switches, sliding parts made of plastic for automobiles or sound apparatus and the like.

PRIOR ART DISCUSSION

In the sliding switch wherein the switch functions by the movable contact of the switch which slides on the surface of a resinous insulating stator equipped with a fixed contact, the following problems are caused by deterioration and the like of grease used for the sliding voltage drop is increased by a drying of the contact surface and oxidation of the sliding surface owing to disappearance of grease and lubricating ingredients on the contact surface and by a formation of foreign substances on the contact surface. Deterioration of the insulating characteristics of the insulator is brought about by adhesion of metallic powder formed by abrasion of the contact and evaporation of the metallic contact caused by arcing and carbonized powder formation of the grease caused by arcing. Induced voltage is caused by chattering of the contact the contact surface being insulated at low temperature by adhesion of high viscous grease to the surface. Cracking of the insulator is brought about by decrease of critical stress caused by soakage of the oil into the insulator and the plastic insulator may be affected by the base oils, such as ester, aromatic oil and the like.

For the following reasons, a grease composition having the following properties (a)–(g) is required in the field of concern:

(a) It is very durable and does not produce foreign substances on the contact surface which brings about high voltage drop under an electric arc.

(b) It does not lose its lubricity under high temperature conditions such as the electric arc and the like and does not increase abrasion and exhaustion on of the contact.

(c) It produces only a small amount of carbonized residue when it is heated under a high temperature condition, such as the electric arc.

(d) It can be used under the condition of from low temperature, to high temperature such as from −30° C. to +150° C.

(e) It does not affect the plastic such as PC, ABS, PMMA and the like.

(f) It has a negative characteristic which shows low resistance value at high temperature and does not bring about an induced voltage caused by chattering on contact.

(g) It has a low oil-separating property and does not deteriorate with the passage of time.

However, a grease composition having all of the abovementioned properties has not yet been provided.

For example, a grease composition which comprises a chain hydrocarbon as a base oil and lithium salt of a fatty acid as a densifying agent lacks the property (c) although it has excellent properties (a) and (e). A grease composition which comprises polybutene as a base oil possesses high viscosity at low temperature although it does exhibit the property (c). A grease composition which comprises an addition oligomer of alkylene oxide and polyvalent alcohol as a base oil and lithium salt of a fatty acid as a consistency builder brings about the exhaustion on contact when it is used in the direct current circuit because the base oil has a negative polarity and also causes the lowering of lubricity because it does not inhibit production of the powder which is formed by abrasion on contact and is charged negatively by friction. Silicone grease lacks in the property (a).

Furthermore, as a relatively excellent grease composition for the sliding switch, the grease compositions which comprise an organophilic quaternary ammonium salt-containing clay mineral in addtion to silicone base oil, hydrocarbon base oil or polyglycol base oil are known. Nevertheless, the silicone grease does not satisfy the requirement (a), the hydrocarbon grease is insufficient in the property (c) and produces a large quantity of carbonized residue, and the polyglycol grease not only produces some amount of the carbonized residue but also does not satisfy the requirements (b) and (g) sufficiently.

In view of the above, the present invention is carried out in order to provide a grease composition having all of the aforesaid properties (a) -(g) which are particularly useful for a contact of a sliding switch, sliding parts made of plastic for automobiles or sound apparatus and the like.

SUMMARY OF THE INVENTION

Therefore, it is an object of the present invention to provide a grease composition for a sliding contact which comprises 100 parts by weight of a base oil consisting of an addition polymerization of an oligomer of alkylene oxide and polyvalent alcohol and a chain hydrocarbon oligomer in a molar ratio of 1:0.2–1:1.5 and 5–30 parts by weight of lithium salt of a higher fatty acid.

Another object of the present invention is to provide a conductive grease composition for a sliding switch which comprises 100 parts by weight of a base oil consisting of an addition polymerization oligomer of alkylene oxide and a polyvalent alcohol and chain hydrocarbon oligomer in a molar ratio of 1:0.5–1:1.5, 10–20 parts by weight of quaternary ammonium salt-containing clay mineral and 5–20 parts by weight of lithium salt of higher a fatty acid.

Furthermore, another object of the present invention is to provide a grease composition which comprises 100 parts by weight of a base oil consisting of an addition polymerization oligomer of alkylene oxide and polyvalent alcohol and a chain hydrocarbon oligomer in a weight ratio of 5:95–95:5, 5–30 parts by weight of lithium salt of a higher fatty acid, 0.5–20 parts by weight of a quaternary ammonium salt-containing clay mineral and 1–30 percent by weight of a polar solvent base on the clay mineral 100 parts.

DISCLOSURE OF THE INVENTION

Figure 1:
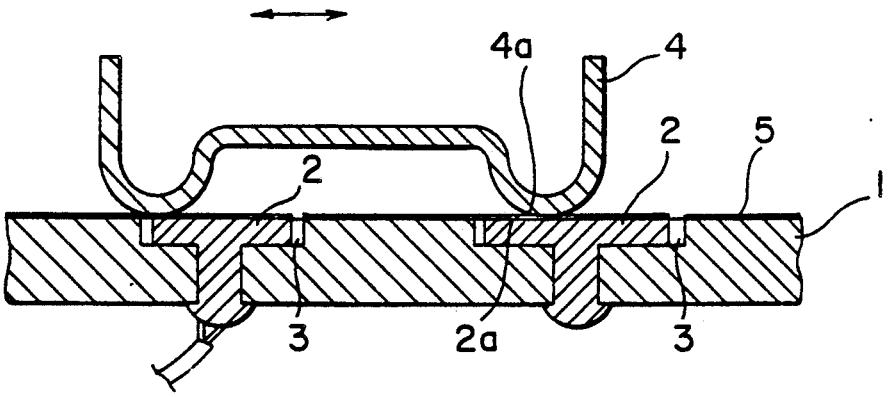
FIG. 1 is a schematic cross section of an embodiment of a sliding switch illustrating a sliding surface contact on which the grease composition according to the present invention can be applied.

According to the first aspect of the present invention, a grease composition for a sliding contact which comprises 100 parts by weight of a base oil consisting of an addition polymerization of an oligomer of alkylene oxide and polyvalent alcohol and chain hydrocarbon oligomer in a molar ratio of 1:0.2–1:1.5 and 5–30 parts by weight of lithium salt of a higher fatty acid is provided.

The addition polymerization oligomer of alkylene oxide and polyvalent alcohol employed in the present invention is a lipophilic oligomer whose molecular weight is usually from 300–4000, are preferably from 1000–2000. Such an oligomer can be prepared according to a conventional procedure by polymerizing one or more of alkylene oxides, such as ethylene oxide, propylene oxide, butylene oxide and the like with one or more of polyvalent alcohols, such as ethylene glycol, propylene glycol and the like.

A particularly suitable addition polymerization oligomer is polyoxyalkylene glycol monoether represented by the formula:

$$\{R_1O-(PO)_n(BO)_m\}_lR$$

wherein $R_1$ is a $C_1$–$C_{18}$ hydrocarbon group which may have a branched chain, R is a hydrogen atom or $C_1$–$C_{18}$ hydrocarbon group which may have a branched chain, PO and BO are a propylene oxide residue and butylene oxide residue respectively, n is an integer of 1–40, m is 0 or an integer of 1 or 2 and l is integer of more than 1.

The molecular weight of the oligomer is usually from 300–3000, preferably 1000–2000, particularly 500–1500.

As the chain hydrocarbon oligomer employed in the present invention, purified paraffin mineral oil, synthetic oil of α-olefin oligomer, polymerized oil of ethylene and α-olefin and the like are exemplified. The molecular weight of the oligomer is usually from 400–3000, preferably 500–1500.

Particularly suitable hydrocarbon oligomers are hydrogenated $C_6$–$C_{12}$ α-olefin oligomer, cooligomer of ethylene and α-olefin wherein the ethylene content is from 30–70 percent by weight and the like.

The base oil of the grease composition according to the present invention comprises the addition polymerization oligomer of alkylene oxide and polyvalent alcohol and the chain hydrocarbon oligomer in a molar ratio of 1:0.2–1:1.5.

Preferred base oil comprises the polyoxyalkylene glycol monoether and the hydrogenated $C_6$–$C_{12}$ α-olefin oligomer or the cooligomer of ethylene and α-olefin whose molecular weight is $\frac{1}{2}$–$\frac{1}{3}$ of that of the polyoxyalkylene glycol monoether in the molar ratio.

When the amount of the addition polymerization oligomer exceeds the aforesaid range, there is a danger of abrasion upon contact in the direct current circuit because of polarity of the base oil. On the other hand, when the amount of the addition oligomer is less than the aforesaid range, carbonized residue of the chain hydrocarbon oligomer produced by arcing at the time of switching increases remarkably.

As the lithium salt of a higher fatty acid, lithium stearate and/or lithium 12-hydroxy stearate and the like are exemplified.

The blending amount of the lithium salt of a higher fatty acid is 5–30 parts by weight in relation to 100 parts by weight of the base oil. If the amount of the salt is below 5 parts by weight, abrasion upon contact with the insulator is increased. When the blending amount of said salt is above 30 parts by weight, application property of the grease composition becomes worse.

An organophilic quaternary ammonium salt-containing clay mineral such as dimethyloctadecyl ammonium montmorillonite, dimethylpentyl octadecyl ammonium hectolite and the like may be added to the grease composition, if desired. The blending amount of the clay mineral is usually 0.5–10 parts by weight in relation to 100 parts by weight of the base oil.

Furthermore, conventional various additives such as a polymeric thickening agent and the like may be added to the grease composition, if necessary, in order to regulate viscosity index, oil separation and the like of the grease composition.

According to a second aspect of the present invention, a conductive grease composition for a sliding switch which comprises 100 parts by weight of a base oil consisting of an addition polymerization oligomer of alkylene oxide and polyvalent alcohol and chain hydrocarbon oligomer in a molar ratio of 1:0.5–1:1.5, 10–20 parts by weight of quaternary ammonium salt-containing clay mineral and 5–20 parts by weight of lithium salt of higher fatty acid is provided.

As the addition polymerization oligomer of alkylene oxide and polyvalent alcohol, the abovementioned oligomers can be used. A particularly suitable addition oligomer is polyoxypropylene glycol monoalkyl ether represented by the formula:

$$RO(CH_2\overset{\overset{CH_3}{|}}{C}HO)_nH$$

wherein R is a $C_1$–$C_{18}$ alkyl group which may have a branched chain and n is integer of 2–40.

As the chain hydrocarbon oligomer, the aforementioned oligomer can be used.

The base oil of the grease composition according to the present invention can be prepared by blending the addition polymerization oligomer of alkylene oxide and polyvalent alcohol with the chain hydrocarbon oligomer in the aforementioned molar ratio.

A preferred base oil comprises the polyoxypropylene glycol monoalkyl ether and the hydrogenated $C_6$–$C_{12}$ $\alpha$-olefin oligomer or the cooligomer of ethylene and $\alpha$-olefin whose molecular weight is $\frac{1}{2}$–$\frac{1}{3}$ of that of the polyoxypropylene glycol monoalkyl ether in the aforementioned molar ratio. The base oil has a suitable low temperature property and oil-separating property.

When the amount of the addition oligomer exceeds the aforesaid range, abrasion wear upon contact increases and the abrasive powder adheres to the insulator. On the other hand, when the amount of the addition polymerization oligomer is less than the aforesaid range, switching power becomes higher and the carbonized residue of the base oil produced by arc heating is increased, the carbonized residue adhering to the insulator to bring about deterioration of the insulation property.

The quaternary ammonium salt-containing clay mineral used in the present invention is an additive which affords conductivity to the grease composition. Particularly suitable clay minerals are dimethyloctadecyl ammonium montmorillonite, dimethylpentyl octadecyl ammonium hectolite and the like. More than two kinds of the clay minerals may be used, if necessary. These clay minerals are commercially available from, for example, Kunimine Kogyo Inc. in Japan.

The blending amount of the quaternary ammonium salt-containing clay mineral is from 10–20 parts by weight in relation to 100 parts by weight of the base oil. If the amount of the clay mineral is below 10 parts by weight, sufficient conductivity is not afforded to the grease composition. When the blending amount of the clay mineral is above 20 parts by weight, application property of the grease composition becomes worse because of increased consistency of the grease composition and the ashes of the clay mineral produced by arc heating are left between the electric contacts.

The lithium salt of higher fatty acid used in the present invention not only increases consistency of the grease composition but also increases lubricity of the interface of the resinous insulator to which inorganic additives such as mineral, glass fiber and the like may be added.

The aforementioned lithium salts of the higher fatty acid can be employed in this case.

The blending amount of the lithium salt of the higher fatty acid is 5–30 parts by weight in relation to 100 parts by weight of the base oil. If the amount of the salt is below 5 parts by weight, the abrasion of the contact and insulator is increased. When the blending amount of said salt is above 30 parts by weight, application property of the grease composition becomes worse.

In order to increase the lubricity still more, an organic molybdenum compound such as molybdenum dithiocarbonate and the like may be added to the conductive grease composition according to the present invention, if necessary. The blending amount of the molybdenum compound is usually 0.1–5 parts by weight.

Furthermore, conventional additives such as a polymeric thickening agent and the like may be added to the grease composition, if necessary, in order to regulate the viscosity index, oil separation and the like of the grease composition.

According to a third embodiment of the present invention, a grease composition which comprises 100 parts by weight of a base oil consisting of addition an polymerization oligomer of alkylene oxide and polyvalent alcohol and chain hydrocarbon oligomer in a weight ratio of 5:95–95:5, 5 –30 parts by weight of a lithium salt of a higher fatty acid, 1–20 parts by weigh of a quaternary ammonium salt-containing clay mineral and 1–30 percent by weight of polar solvent based on the clay mineral 100 parts is provided.

As the addition polymerization oligomer of alkylene oxide and polyvalent alcohol, the aforementioned addition oligomers can be used. A particulary suitable oligomer, is the aforesaid polyoxypropylene glycol monoalkyl ether.

As the chain hydrocarbon oligomers, the aforementioned oligomers such as purified paraffin oil and the like can be used.

The base oil is prepared by blending the addition polymerization oligomer and the chain hydrocarbon oligomer in the weight ratio of 5:95–95:5.

As the lithium salt of higher fatty acid, the aforesaid salts such as lithium stearate and the like can be used.

The blending amount of the lithium salt of higher fatty acid is 5–30 parts by weight, preferably 5–20 parts by weight. When the blending amount is from less than 5 parts by weight, decrease of abrasion resistance upon contact is brought about and the softened grease composition is fluidized and the shear stability thereof becomes worse. When the blending amount is more than 30 parts by weight, the grease composition becomes too hard and the application property thereof becomes worse.

A grease composition having stability can be obtained by using an organophilic quaternary ammonium salt-containing clay mineral such as those mentioned above in combination with the lithium salt of the higher fatty acid.

The blending amount of the clay mineral is 1–20 parts by weight in relation to 100 parts by weight. If the blending amount is below 1 part by weight, enhanced stability of the grease composition can not be obtained and the oil is apt to separate. When the blending amount is above 20 parts by weight, radicals and ashes are produced from the clay mineral under high temperature conditions, such as arc heating and the like.

As the polar solvent, methyl alcohol, propylene carbonate, acetone, benzyl alcohol and optional mixtures thereof are exemplified.

The blending amount of the polar solvent is 1–30 percent by weight, preferably 1–20 percent by weight based on the quaternary ammonium salt-containing clay mineral. When the blending amount is less than 1 percent by weight, sufficient consistency cannot be obtained and stability of the grease composition decreases. If the blending amount is above 30 percent by weight, consistency of the grease composition becomes unnecessarily high and a loss of the amount of heat is brought about in order to remove the excess amount of the solvent.

Conventional additives such as an antioxidant, polymeric thickening agent and the like may be added to the grease composition according to the present invention, if desired.

The aforementioned three types of grease compositions are suitable composition for the sliding surface of the contacts of the sliding switch, as shown in FIG. 1. The sliding switch consists of a resinous insulator (1), the fixed contacts (2), which are buried in the insulator, and the movable contact (4). The air gap (3) is provided between the insulator (1) and the fixed contact (2). The make and break of the sliding switch is carried out by sliding the contacting part (4*a*) of the movable contact (4) onto the sliding surface of the insulator (1) to touch and detach the contacting part (2*a*) of the fixed contact (2). Electric arcing is generated by the switching of from several amperes to several tens amperes of electric current caused by load break in the air gap at the time of the switching. The grease composition (5) is applied on the surfaces of the insulator (1) and the fixed contact (2) in a desired thickness.

PREFERRED EMBODIMENTS

The present invention is illustrated by the following examples.

EXAMPLES

Examples 1–3

Grease composition 1 (example 1), 2 (example 2) and 3 (example 3) were prepared according to the conventional procedure in conformity with the blending prescriptions described in Table 1. Properties of these grease compositions are shown in Table 1.

Comparative Examples 1–4

Grease compositions 1′ (comparative example 1), 2′ (comparative example 2), 3′ (comparative example 3) and 4′ (comparative example 4) were prepared according to the conventional procedure in conformity with the blending prescriptions described in Table 1. Properties of these grease compositions are shown in Table 1.

Examples 4–6

Grease compositions 4 (example 4), 5 (example 5) and 6 (example 6) were prepared according to the ocnventional procedure in conformity with the blending prescriptions described in Table 2. Properties of these grease compositions are shown in Table 2.

Comparative Examples 5–7

Grease compositions 5′ (comparative example 5), 6′ (comparative example 6) and 7′ (comparative example 7) were prepared according to the conventional procedure in conformity with the blending prescriptions described in Table 2. Properties of these grease compositions are shown in Table 2.

PERFORMANCE TEST OF THE SLIDING SWITCH

Figure 2:
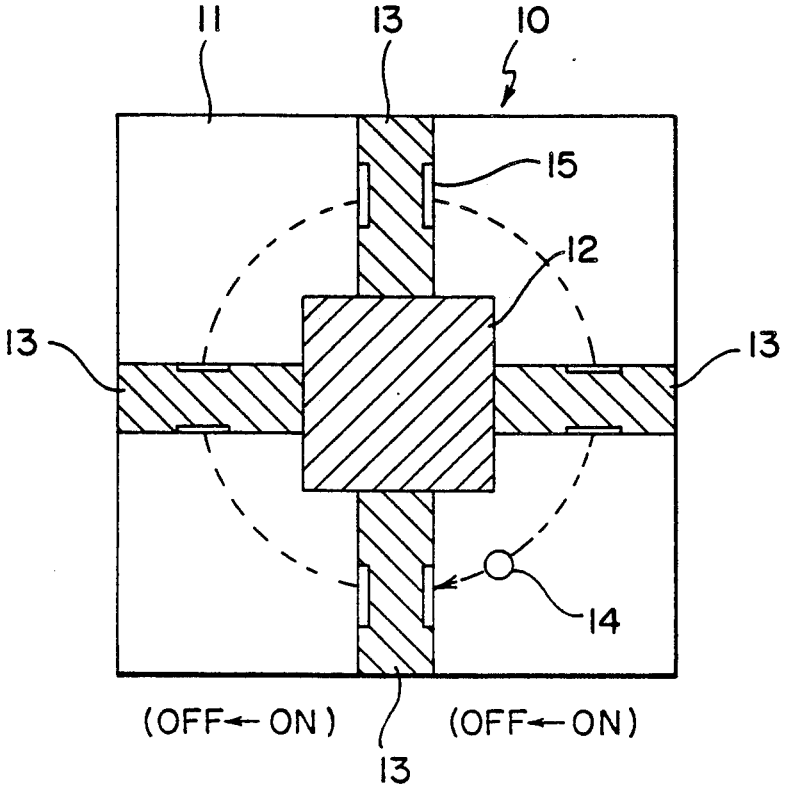
FIG. 2 is a schematic plan of a stator of a sliding switch employed in a test for durability of the grease composition of the present invention.
Figure 3:
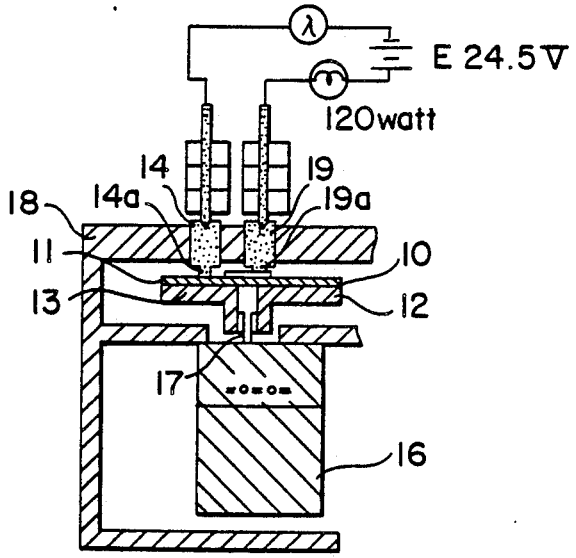
FIG. 3 is a schematic cross section of an apparatus for testing durability of the grease composition of the present invention.

Performance test of the sliding switch shown in FIGS. 2 and 3 by using the grease compositions prepared in examples 1–6 and comparative examples 1–7.

The sliding switch for the performance test which is similar to that shown in FIG. 1 was constructed. In the stator shown in FIG. 2, the fixed contact (12) is buried in the central part of the insulator (11) and the fixed contacts (13) are buried in the insulator (11) with the space of 90° as shown in FIG. 2. The air gaps (15) are provided in the both sides of the fixed contact (13) to which the sliding part of the movable contact (14) is touched.

As shown in FIG. 3, the stator (10) is fixed to the shaft (17) of the rotary motor (16) and the pair of movable contacts (14) and (19) fixed to the stand (18) is arranged above the stator (10). The make and break of the sliding switch is performed by keeping the contact surface (19*a*) of the movable contact (19) in touch with the fixed contact (12) at all times and by touching or detaching the contacting part (14*a*) of the movable contact (14) to or from the fixed contacts (13).

As the resinous insulator (11), the molded insulator made of nylon 66 with which 20 percent of kaolin and 20 percent of talc are blended (insulator I) or the molded insulator made of polyester with which 20 percent of glass fiber is blended (insulator II) was used.

Copper contacts were used as the contacts (12), (13), (14) and (19).

Each of the grease compositions was coated on the surfaces of the resinous insulator (11) as well as the fixed contacts (12) and (13). The coating weight was 10 mg/cm$^2$.

In order to generate sufficient electric arc at the switching time, following test conditions were employed: DC 24.5 V; 120 W; switching speed 1 cm/sec. Performance of the sliding switch was estimated by making more than 50000 sliding revolutions of the movable contact. The estimated results are shown in Tables 1 and 2.

In Tables 1 and 2, tests I and II indicate the performance test of the sliding switch wherein the insulators I and II were used respectively.

The estimation criteria of the durability performances (a′)–(f′) of the sliding switch are as follows:

| | |
|---|---|
| (a′); | A: Voltage drop is less than 50 mV |
| | B: Voltage drop is more than 50 mV |
| (b′); | A: Abrasion wear of the contact is less than 2.5 mg when 15 mg of the movable contact is slid 50000 cycles. |
| | B: Said abrasion wear is more than 2.5 mg. |
| (c′); | A: Insulation resistance at the point at a distance of 3 mm from the air gap is more than 10MΩ. |
| | B: Said insulation resistance is less than 10MΩ. |
| (d′); | A: Induced voltage is not generated by several microns of chattering of the contact. |
| | B: Said induced voltage is generated. |
| (e′); | A: Starting torque and turning torque at −30° C. are less than 2000 gcm and less than 1000 gcm respectively. |
| | B: Said starting torque and turning torque are more than 2000 gcm and more than 1000 gcm respectively. |
| (f′); | A: Resins such as PC, PMMA and ABS are not deteriorated at 80° C. (Critical stress of the resins is not lowered.) |

-continued

| |
|---|
| B: Said resins are deteriorated. |

Concerning the several kinds of grease compositions, the relations of durability frequency with voltage drop or insulation resistance measured at the point at a distance of 3mm from the air gap were investigated. Maximum values of voltage drop or insulation resistance were measured at four points of the stator shown in FIG. 2. In all cases, the insulator I was used as the resinous insulator. The result obtained are shown in FIGS. 4–17.

Example 7–9

Grease compositions 7 (example 7), 8 (example 8) and 9 (example 9) were prepared according to the prescriptions described in Table 1. Properties conventional procedure in conformity with the blending prescriptions described in Table 3. Properties of these grease compositions are shown in Table 3.

Comparative Examples 8–10

Grease compositions 8′ (comparative example 8), 9′ (comparative example 9) and 10′ (comparative example 10) were prepared according to the conventional procedure in conformity with the blending prescriptions described in Table 3. Properties of these grease compositions are shown in Table 3.

Figure 18:
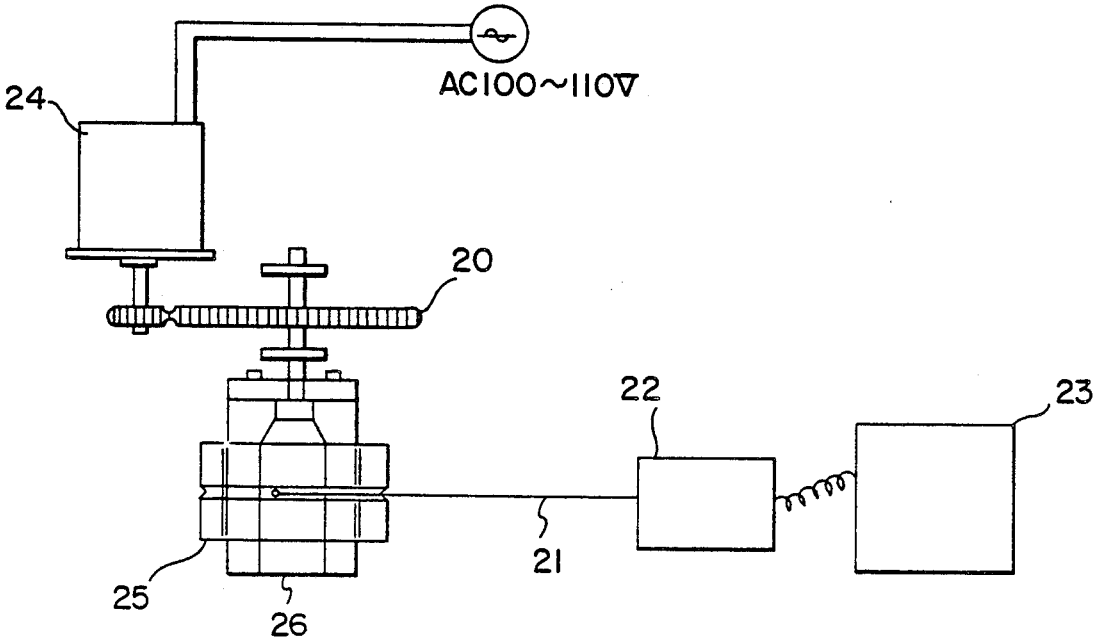
FIG. 18 is a schematic drawing of the apparatus used for measuring turning torque.

In Table 3, viscosity temperature properties of the grease compositions 7–9 and 8′–10′ are also shown. The viscosity temperature property was measured by means of the torque testing machine shown in FIG. 18. The testing apparatus consists mainly of spur gear (20), strain gauge (22), inner pipe (26), outer pipe (25), tension wire (21), recorder (23) and motor (24).

The grease composition (about 0.3 g) is coated on about three quarters of the sliding surface from this side of the inner pipe (about 30 mmϕ) and the outer pipe (25) is mounted on the inner pipe (26) with a clearance of about 0.03 mm. The tension wire (21) is set on the outer pipe (25) and the inner pipe (26) is rotated (15 rpm) at mean circumferential velocity of 1.0 cm/sec. Turning torque after 4 minutes is measured.

Low temperature torque in accordance with JIS K2220.5.14 is also shown in Table 3.

As described above, the grease compositions having the aforementioned desired properties (a)–(f) and low degree of oil separation can be prepared by blending the defined amounts of specific additives with the base oil consisting of the chain hydrocarbon oligomer and the addition polymerization oligomer of alkylene oxide and polyvalent alcohol. When only the polyoxypropylene glycol monoether is used as the base oil, abrasion and exhausion of the contact are remarkable and abrasion powder of copper contact is adhered to the insulator in the neighborhood of arc gap at the time of current breaking to deteriorate insulation property (cf. FIG. 7).

Figure 9:
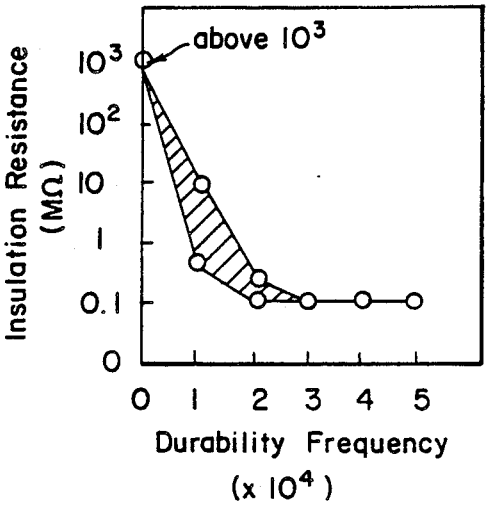
FIG. 9 shows the relation between insulation resistance and durability frequency of the grease composition 4' prepared in comparative example 4.

When only the polymerized oil of ethylene and α-olefin is used as the base oil, the grease composition is carbonized remarkably and not only the large amounts of carbonized residue but also the abrasion powder of contact are adhered to the sliding surface of the insulatior in the neighborhood of arc gap at the time of current breaking to bring about remarkable deterioration of insulation property and abrasion of the contact (cf. FIG. 9).

Figure 4:
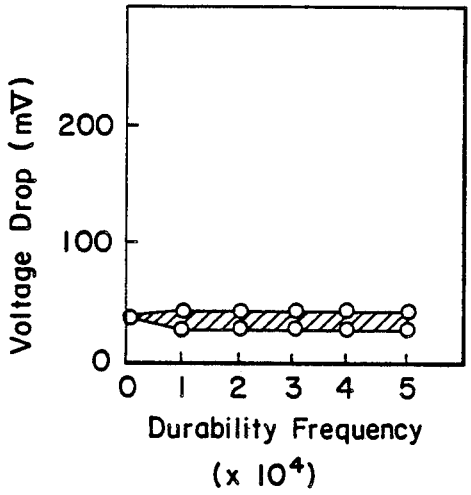
FIG. 4 shows the relation between voltage drop and durability frequency of the grease composition 2 prepared in example 2.
Figure 5:
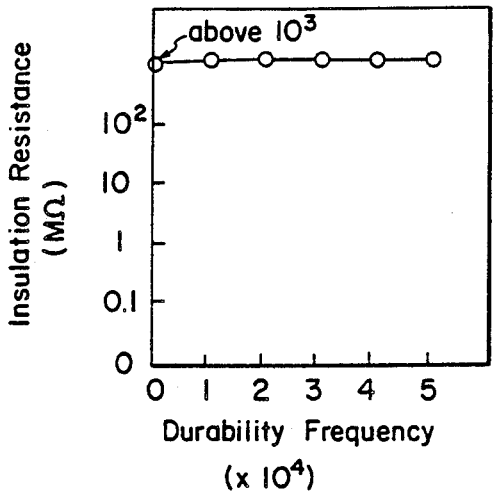
FIG. 5 shows the relation between insulation resistance and durability frequency of the grease composition 2.
Figure 6:
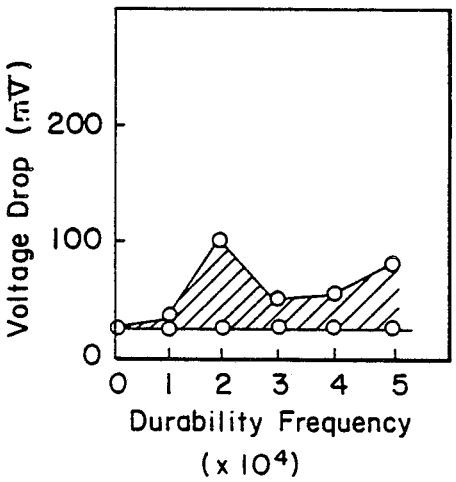
FIG. 6 shows the relation between voltage drop and durability frequency of the grease composition 2' prepared in comparative example 2.
Figure 7:
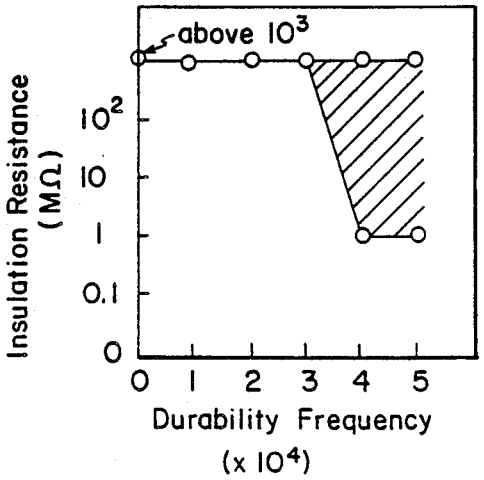
FIG. 7 shows the relation between insulation resistance and durability frequency of the grease composition 2'.
Figure 8:
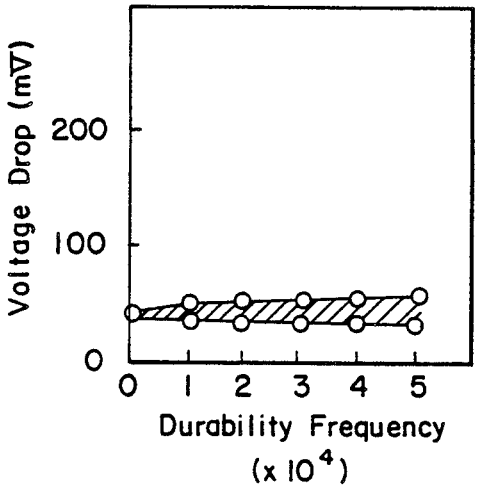
FIG. 8 shows the relation between voltage drop and durability frequency of the grease composition 3' prepared in comparative example 3.

On the other hand, when the defined amounts of polyoxypropylene glycol monoether and the polymerized oil of ethylene and α-olefin are used jointly as the base oil, only small amount of the grease composition is carbonized and lost by arc heating if the switching of current is repeated and only small amount of the abrasion powder of the contact is adhered to the sliding surface of the insulator and therefore the increase of voltage drop and the deterioration of insulation property are not brought about (cf. FIG. 4 and 5).

Accordingly, the grease composition provided by first aspect of the present invention improves reliability and durability of the sliding switch sharply. Although the grease composition can be used widely as the grease for the contact of the sliding switch, it is particularly suitable as the grease for the sliding contact of the automobiles and the like.

Figure 12:
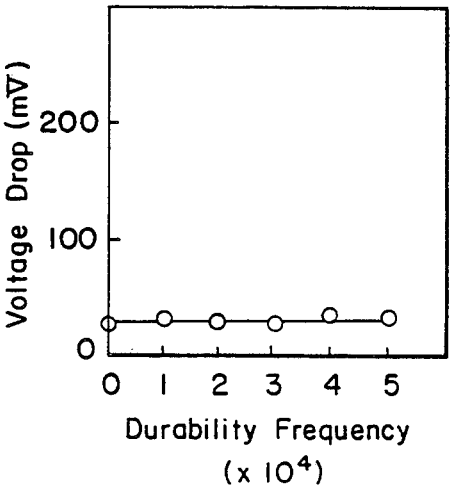
FIG. 12 shows the relation between voltage drop and durability frequency of the grease composition 5' prepared in comparative example 5.
Figure 13:
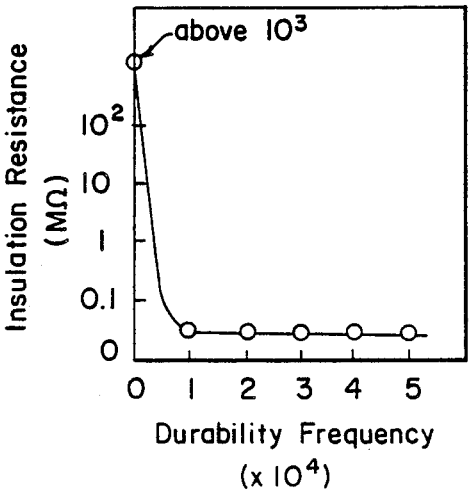
FIG. 13 shows the relation between insulation resistance and durability frequency of the grease composition 5'.

When only the synthetic oil of α-olefin oligomer is used, abrasion of the contact is increased and the abrasion powder is adhered to the insulator to bring about the deterioration of the insulation property (cf. FIG. 12 and 13).

Figure 14:
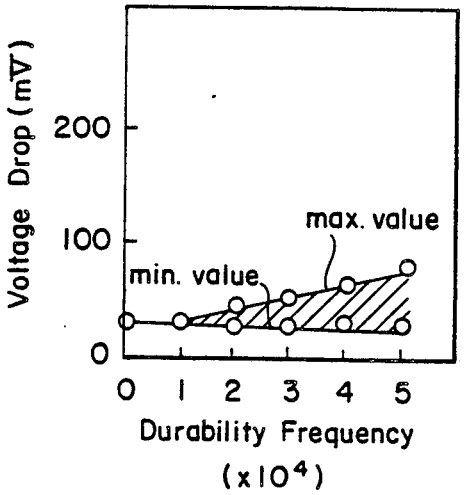
FIG. 14 shows the relation between voltage drop and durability frequency of the grease composition 6' prepared in comparative example 6.
Figure 15:
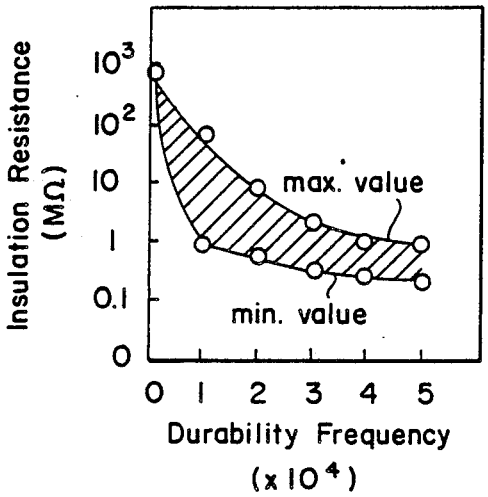
FIG. 15 shows the relation between insulation resistance and durability frequency of the grease composition 6'.

When only the polyoxypropylene glycol monoether is used as the base oil, the carbonized residue is produced and the insulation property is deteriorated (fc. FIG. 14 and 15).

Figure 16:
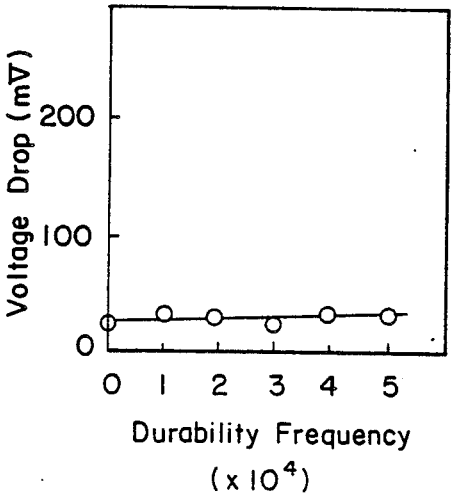
FIG. 16 shows the relation between voltage drop and durability frequency of the grease composition 7' prepared in comparative example 7.
Figure 17:
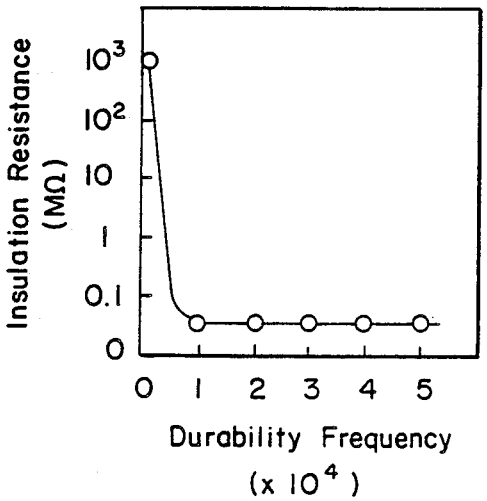
FIG. 17 shows the relation between insulation resistance and durability frequency of the grease composition 7'.

In the case of the grease composition 7′ which comprises the synthetic oil of α-olefin oligomer, lithium stearate and the organic molybdenum compound, remarkable carbonization of the grease composition and abrasion of the contact are observed (cf. FIG. 16 and 17).

Figure 10:
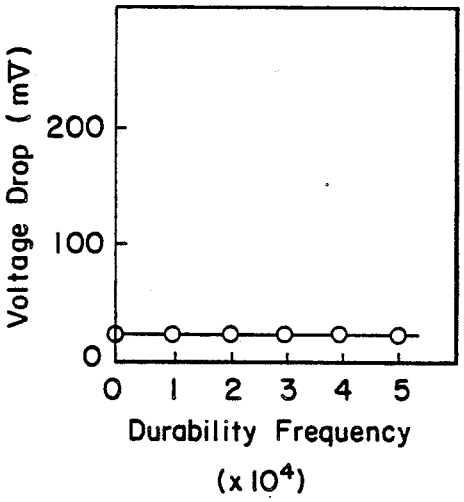
FIG. 10 shows the relation between voltage drop and durability frequency of the grease composition 4 prepared in example 4.
Figure 11:
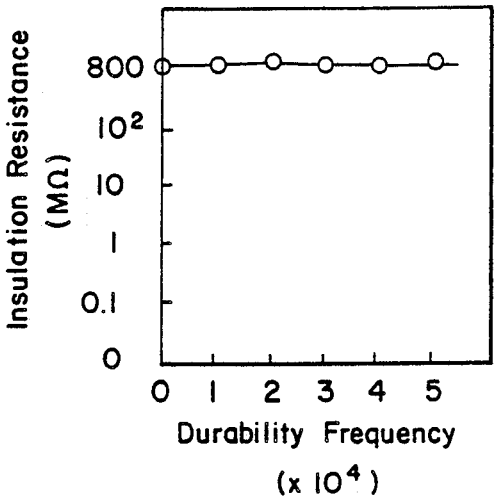
FIG. 11 shows the relation between insulation resistance and durability frequency of the grease composition 4.

On the other hand, in the case of the grease composition 4 which comprises the base oil consisting of specified amounts of the polyoxypropylene glycol and the synthetic oil of α-olefin oligomer and the defined amounts of lithium stearate, quaternary ammonium salt-containing clay mineral and the organic molybdenum compound, the carbonization of the grease composition and the exhaustion of the contact are extremely small and the increase of voltage drop and the insulation deterioration of the insulator are not observed (cf. FIG. 10 and 11).

Therefore, the grease composition provided by the second embodiment of the present invention improves reliability and durability of the sliding switch sharply. The grease composition is suitable as a lubricating grease for the sliding surface of the contact and the insulator or a switch for sending an electric current and a change-over switch for small and large electric current.

The grease composition provided by the third embodiment of the present invention is particularly suitable for a lubricating grease for plastics and a grease for an electric switch which generates an electric arc because the degree of oil separation is low, the stability with the lapse of time is high, excellent sound arresting effect and smooth feeling of use are obtained becuase of higher turning torque at room temperature of the working parts to which the grease composition is applied, and carbon sludge is not produced easily. For example, the grease compsition can be used effectively in the fields of plastics parts of automobiles, plastics parts of sound apparatus, sliding contact switch and the like.

TABLE 1

| Grease compositions | 1 | 2 | 3 | 1' | 2' | 3' | 4" |
|---|---|---|---|---|---|---|---|
| Ingredients(1) | | | | | | | |
| Polyoxypropylene glycol monoether(2) | 60 | | | | 80J | | |
| Polyoxypropylene glycol monoether(3) | | 50 | 60 | | | | 20 |
| Polimerized oil of α-olefin(4) | 20 | | | 80 | | | 60 |
| Polimerized oil of ethylene and α-olefin(5) | | 30 | 20 | | | 80 | |
| Quaternary ammonium salt-containing clay mineral | 2 | 1 | 2 | | | | |
| Lithium stearate | 18 | 19 | 18 | 20 | 20 | 20 | 20 |
| Properties of Grease Composition | | | | | | | |
| Cone Penetration (JIS K-2220 5.3) | 277 | 269 | 270 | 272 | 273 | 270 | 285 |
| Dropping point (°C.) (JIS K-2220 5.4) | 204 | 204 | 202 | 199 | 204 | 203 | 192 |
| Copper Corrosion (100° C., 24H) | Non | Non | Non | Non | Non | Non | Non |
| Oil Separation (%) (100° C., 24H) | 0.5 | 1.0 | 1.0 | 5.0 | 0.5 | 0.1 | 5.0 |
| Durability of the Sliding Switch | | | | | | | |
| (a') Test I | A | A | A | A | B(100 mV) | A | A |
| Test II | A | A | A | A | B(100 mV) | A | A |
| (b') Test I | A | A | A | B(4 mg) | B(5 mg) | B(4 mg) | B |
| Test II | A | A | A | B(4 mg) | B(5 mg) | B(4 mg) | B |
| (c') Test I | A | A | A | B(0.1MΩ) | B (6) | B(0.1MΩ) | B(0.1MΩ) |
| Test II | A | A | A | B(0.1MΩ) | B (6) | B(0.1MΩ) | B(0.1MΩ) |
| (e') Test I | A | A | A | A | A | A | A |
| Test II | A | A | A | A | A | A | A |
| (f') Test I | A | A | A | A | A | A | A |
| Test II | A | A | A | A | A | A | A |

(1)Unit of blending amount of the ingredient is parts by weight.;
(2)NEW POLE 285 (mean molecular weight: 1200, viscosity: 64 cst/40° C.) (Sanyo Kasei Inc.);
(3)NEW POLE LB 625 (mean molecular weight: 1850, viscosity: 124 cst/40°C.) (Sanyo Kasei Inc.);
(4)LIPOL UBE mixture (mean molecular weight: 600, viscosity: 49 cst/40° C.) (Lyon Yushi Inc.);
(5)HC-40 (mean molecular weight: 1000, viscosity: 380 cst/40° C.) (Mitsui Sekyu Kagaku Inc.);
(6)Although the grease composition was not carbonized, the insulation property was deteriorated by the adhesion of copper powder (1MΩ).

TABLE 2

| Grease compositions | 4 | 5 | 6 | 5' | 6' | 7' |
|---|---|---|---|---|---|---|
| Ingredients(1) | | | | | | |
| Polyoxypropylene glycol monoether(2) | 46 | 48 | | | 70 | |
| Polyoxypropylene glycol monoether(3) | | | 35 | | | |
| Polimerized oil of α-olefin(4) | 26 | | 35 | 70 | | 75 |
| Polimerized oil of ethylene and α-olefin(5) | | 26 | | | | |
| Lithium stearate | 12 | 13 | 15 | | | 25 |
| Quaternary ammonium salt-containing clay mineral(6) | 12 | 13 | 15 | 30 | 30 | |
| Organic molybdenum compound(7) | 4 | | | | | |
| Properties of Grease Composition | | | | | | |
| Penetration (JIS K-2220 5.3) | 275 | 272 | 270 | 270 | 275 | 279 |
| Dropping point (°C.) (JIS K-2220 5.4) | 201 | 204 | 205 | >300 | >300 | 191 |
| Copper Corrosion (100° C., 24H) | Non | Non | Non | Non | Non | Non |
| Oil Separation (%) (100° C., 24H) | 1.0 | 0.9 | 1.0 | 5.0 | 5.0 | 7.0 |
| Durability of the Sliding Switch | | | | | | |
| (a') Test I | A | A | A | B | A | A |
| Test II | A | A | A | B | A | — |
| (b') Test I | A | A | A | B(5 mg) | B(4 mg) | B(5 mg) |
| Test II | A | A | A | B(5 mg) | B(4 mg) | — |
| (c') Test I | A | A | A | B(<0.1MΩ) | B | B |
| Test II | A | A | A | B(<0.1MΩ) | B | — |
| (d') Test I | A | A | A | A | A | B |
| Test II | A | A | A | A | A | — |
| (e') Test I | A | A | A | A | A | A |
| Test II | A | A | A | A | A | — |
| (f')(8) Test I | A | A | A | A | A | A |

TABLE 2-continued

| Grease compositions | 4 | 5 | 6 | 5' | 6' | 7' |
|---|---|---|---|---|---|---|
| Test II | A | A | A | A | A | — |

(1)Unit of blending amount of the ingredient is parts by weight.;
(2)NEW POLE 285;
(3)NEW POLE 285;
(4)LIPOLUBE (mean molecular weight: 800);
(5)LUCANT HC-40 (mean molecular weight: 1000) (Mitsui Sekyu Kagaku Inc.);
(6)dimethyl dioctadecyl ammonium montmorillonite (Kunimine Kogyo Inc.);
(7)molybdenum dithiocarbonate;
(8)Stress was applied to the test piece for bend test (¼" × ½" × 5") made of PC, ABS or PMMA on which the grease composition was coated for 3 hours at 90° C. and the existence of crackes owing to decrease of critical stress was cheched up.

TABLE 3

| Grease compositions | 7 | 8 | 9 | 8' | 9' | 10' |
|---|---|---|---|---|---|---|
| Ingredients(1) | | | | | | |
| Polyoxypropylene glycol monoether(2) | 56 | 40 | | 40 | | 80 |
| Polyoxypropylene glycol monoether(3) | | | 70 | | | |
| Polimerized oil of α-olefin(4) | | 40 | 7 | 40 | 80 | |
| Polimerized oil of ethylene and α-olefin(5) | 23 | | | | | |
| Lithium stearate | 14 | 10 | 20 | 19 | 18 | 18 |
| Quaternary ammonium salt-containing mineral | 7 | 10 | 3 | | | |
| Methyl alcohol | 2 | 3 | 0.5 | | | |
| 2,6-Di-t-butyl-n-methyl phenol | 1 | 1 | 0.5 | 1 | 1 | 1 |
| Thickening agent | | | | | 1 | 1 |
| Properties of Grease Composition | | | | | | |
| Consistency (JIS K 2220 5.3) | 275 | 270 | 270 | 285 | 271 | 275 |
| Dropping point (°C.) (JIS K 2220 5.4) | 202 | 203 | 203 | 192 | 201 | 200 |
| Copper corrosion (JIS K 2220 5.7) | Non | Non | Non | Non | Non | Non |
| Oil separation (JIS K 2220 5.7) | 0.1 | 0.1 | 0.5 | 7.5 | 6.0 | 5.0 |
| Insulation Resistance of the Sliding Switch(6) | A | A | A | A | B | A |
| Viscosity Temperature Property | | | | | | |
| Low temperature (gfc/−30° C.) (JIS K 2220 5.14) | 900 | 590 | 780 | 600 | 780 | 800 |
| Turning torque (g/25° C.) | 200 | 120 | 180 | 70 | 80 | 100 |

(1)Unit of blending amount of the ingredient is parts by weight.;
(2)viscosity: 64 cst/40° C.;
(3)viscosity: 124 cst/40° C.;
(4)viscosity: 50 cst/40° C.;
(5)viscosity: 380 cst/40° C.;
(6)A: Insulation resistance at the point at a distance of 3 mm from the air gap is more than 100 MΩ. B: Minimum value of said insulation resistance is less than 1.0 MΩ.

We claim:

1. A grease composition for a sliding contact which comprises 100 parts by weight of a base oil consisting of a mixture of an addition polymerization oligomer of alkylene oxide and polyvalent alcohol and a chain hydrocarbon oligomer in a molar ratio of 1:0.2–1:1.5, and 5–30 parts by weight of a lithium salt of a higher fatty acid, and 0.5–10 parts by weight of an organophilic quaternary ammonium salt-containing clay mineral.

2. The grease composition according to claim 1, wherein the addition polymerization oligomer is a polyoxyalkylene glycol ether represented by the formula:

$$(R_1O—(PO)_n(BO)_m\}_lR$$

wherein $R_1$ is $C_1$–$C_{18}$ hydrocarbon group which may have a branched chain, R is hydrogen atom or $C_1$–$C_{18}$ hydrocarbon group which may have a branched chain, PO and BO represent a propylene oxide residue and butylene oxide residue, respectively, n is integer of 1–40, m is 0 or an integer of 1 or 2 and is an integer of more than 1.

3. The grease composition according to claim 2, wherein said chain hydrocarbon oligomer is selected from at least one member of a purified paraffin mineral oil, a synthetic oil of an α-olefin oligomer, and a polymerized oil of ethylene and an α-olefin, of which the molecular weight is ½–⅓ that of said polyoxyalkylene glycol ether.

4. A conductive grease composition for a sliding switch which comprises 100 parts by weight of a base oil consisting of an addition polymerization oligomer of alkylene oxide and a polyvalent alcohol and a chain hydrocarbon oligomer in a molar ratio of 1:0.5–1:1.5, 10–20 parts by weight of organophilic quaternary ammonium salt-containing clay mineral and 5–20 parts by weight of a lithium salt of a higher fatty acid.

5. The grease composition according to claim 4, wherein said addition polymerization oligomer is polyoxypropylene glycol monoalkyl ether represented by the formula:

$$RO(CH_2\overset{\overset{CH_3}{|}}{C}HO)_nH$$

wherein R is a $C_1$–$C_{18}$ alkyl group which may have a branched chain and n is an integer of 2–40.

6. The grease composition according to claim 5, wherein said chain hydrocarbon oligomer is a $C_6$–$C_{12}$ hydrogenated α-olefin-ethylene cooligomer having an ethylene content of from 30–70 percent by weight, the molecular weight of said chain hydrocarbon oligomer being $\frac{1}{2}$–$\frac{1}{3}$ of that of said polyoxypropylene glycol monoalkyl ether.

7. The grease composition according to claim 4, wherein said quaternary ammonium salt-containing clay mineral is selected from the group consisting of dimethyl-octadecyl ammonium montmorillonite, dimethylpentyl octadecyl ammonium hectolite, and mixtures thereof.

8. The grease composition according to claim 4, wherein said lithium salt is lithium stearate.

9. A grease composition which comprises 100 parts by weight of a base oil consisting of an addition polymerization oligomer of alkylene oxide and a polyvalent alcohol and a chain hydrocarbon oligomer in a weight ratio of 5:95–95:5, 5–30 parts by weight of a lithium salt of a higher fatty acid, 0.5–20 parts by weight of a quaternary ammonium salt-containing clay mineral and 1–30 percent by weight of polar solvent based on said clay mineral.

10. The grease composition according to claim 9, wherein said addition polymerization oligomer is polyoxypropylene glycol monoalkyl ether represented by the formula:

$$RO(CH_2\overset{\overset{CH_3}{|}}{C}HO)_nH$$

wherein R is a $C_1$–$C_{18}$ alkyl group which may have a branched chain and n is integer of 2–40.

11. The grease composition according to claim 9, wherein said chain hydrocarbon oligomer is a $C_6$–$C_{12}$ hydrogenated $\alpha$-olefin oligomer and/or cooligomer of ethylene and $\alpha$-olefin wherein the ethylene content is 30–70 percent by weight.

12. The grease composition according to claim 9, wherein said lithium salt of a higher fatty acid is selected from the group consisting of lithium stearate, lithium 12-hydroxy stearate, and mixtures thereof.

13. The grease composition according to claim 9, wherein said quaternary ammonium salt-containing clay mineral is selected from the group consisting of dimethyl-octadecyl ammonium montmorillonite, dimethylpentyloctadecyl ammonium hectolite and mixtures thereof.

14. The grease composition according to claim 9, wherein said polar solvent is alcohol, propylene carbonate, aceton and/or benzyl at least one solvent selected from the group consisting of methyl alcohol, propylene carbonate, acetone and benzyl alcohol.

* * * * *